US006390654B1

(12) United States Patent
Diaz et al.

(10) Patent No.: US 6,390,654 B1
(45) Date of Patent: May 21, 2002

(54) INTERIOR/INDUSTRIAL LUMINAIRE

(75) Inventors: José Diaz; Thierry Fleury, both of Nevers; Serge Lavergne, La Machine, all of (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/567,483

(22) Filed: May 9, 2000

(30) Foreign Application Priority Data

May 11, 1999 (FR) ..... 99 06014

(51) Int. Cl.[7] ..... F21V 17/00; F21S 8/04

(52) U.S. Cl. ..... 362/375; 362/223; 362/310; 362/329; 362/260

(58) Field of Search ..... 362/217, 223, 362/260, 375, 328, 329, 310, 308, 327, 147

(56) References Cited

U.S. PATENT DOCUMENTS 4,462,068 A * 7/1984 Shadwick ..... 362/375
4,573,111 A * 2/1986 Herst et al. ..... 362/223
5,025,355 A * 6/1991 Harwood ..... 362/223
5,746,502 A * 5/1998 Huang ..... 362/223
6,053,625 A * 4/2000 Bowker ..... 362/328

FOREIGN PATENT DOCUMENTS

DE 3442527 A1 5/1985 ..... F21V/31/02
EP 0179453 A1 4/1986 ..... F21S/3/02

* cited by examiner

*Primary Examiner*—Alan Cariaso
*Assistant Examiner*—Peggy A. Neils
(74) *Attorney, Agent, or Firm*—Dicran Halajian; Frank Keegan

(57) ABSTRACT

The luminaire comprises a roof (20) and a transparent cover (30) as well as a plate (10) which supports internal functional elements (15, 45, 25) of the luminaire. The roof and the cover each have edges which correspond to one another, thus rendering possible an assembly by the edges with a joint (5).

The plate (10) is held in place by clamping between the roof and the cover. The lateral walls of the roof have an inclined portion (3), and the edge of the plate is provided with a folded and inclined portion (2) which is pressed against the corresponding inclined portion of the roof.

15 Claims, 1 Drawing Sheet

INTERIOR/INDUSTRIAL LUMINAIRE

BACKGROUND OF THE INVENTION

The invention relates to a luminaire comprising inter alia a housing and a plate, said housing comprising at least a first half shell referred to as "roof" and fitted with means for fixing it to a support, and a second, transparent half shell referred to as "cover", each of said half shells having edges which correspond with one another so as to permit an assembly of the half shells with one another by the edges in their operational position, while the plate supports internal functional elements of the luminaire.

A luminaire comprising a housing and a plate as described above is known from the document EP 0 173 453. According to this document, the luminaire is formed by two trough-shaped half shells, and an L-shaped rail section supports the installation elements as well as a reflector. The rail is fixed to the upper portion of the roof.

SUMMARY OF THE INVENTION

It is an object of the invention to reduce the weight of the luminaire.

To achieve this, the plate is held in place by clamping between the roof and the cover.

The basic idea accordingly is to improve the rigidity through the mutual retention of the plate by the housing and vice versa, which renders it possible to utilize thinner half shells and to economize on material.

Advantageously, the plate is provided with an edge whose shape corresponds to that of the edge of the roof portion and the edge of the cover such that it is well retained between these latter two edges.

In a special embodiment of a luminaire of elongate shape, the two longitudinal lateral walls of the roof each have a portion which is inclined with respect to the direction of alignment of the plate when it is in its position, the edge of the plate is provided with an inclined portion which corresponds to the inclined portion of the roof, and the inclined portion of the plate is pressed against the corresponding inclined portion of the roof when the plate is assembled between the roof and the cover.

In addition to the improved rigidity provided by this arrangement, it also provides a better thermal contact between the plate, which supports elements which generate heat, and the housing, which removes this heat.

Further special embodiments are defined below in this Specification.

These as well as other, more detailed aspects of the invention will become evident from the following description of an embodiment which is given by way of non-limitative example.

DETAILED DESCRIPTION OF THE PREFERRED EMBODIMENTS

Figure 1:
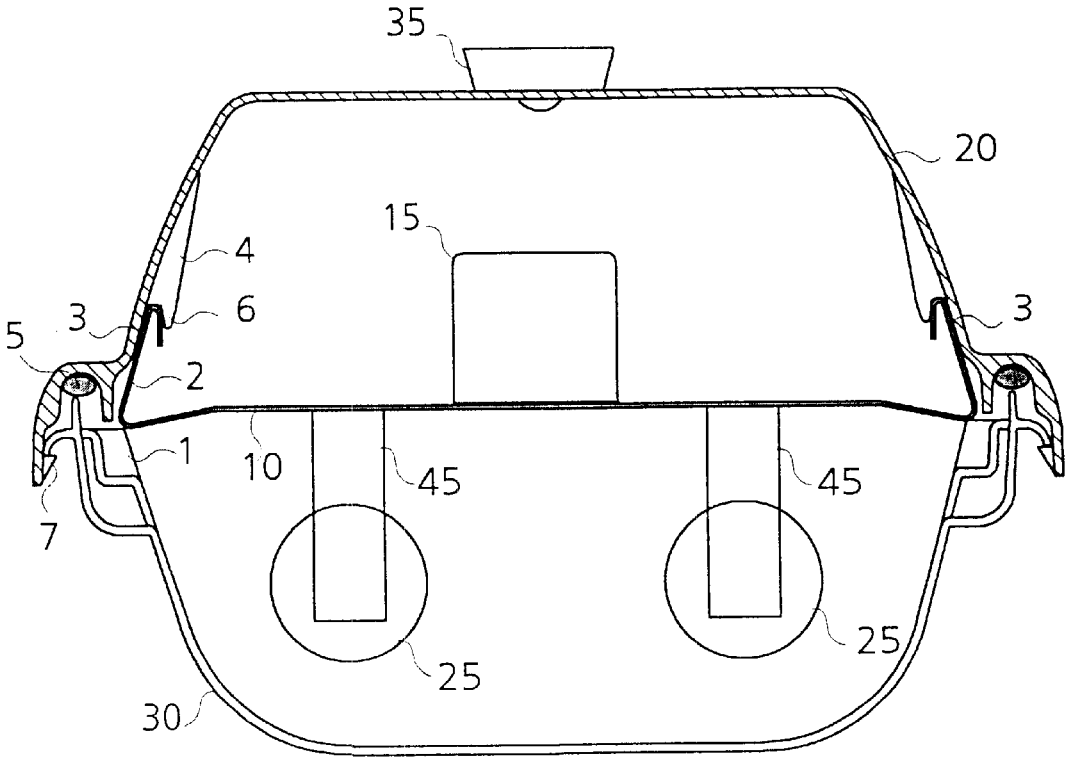
FIG. 1 is a cross-sectional view of a luminaire according to the invention.

The luminaire in FIG. 1 comprises a housing which comprises at least a first half shell 20 referred to as "roof". It is provided with any fixation means 35 which are known per se for fastening to a support (not shown), which may be a wall, a ceiling, etc.

A second, transparent half shell 30 referred to as "cover" is assembled together with the roof in the operational position, below the roof 20 in the representation shown here.

Each of these half shells has edges corresponding to those of the other, thus enabling an assembly of the half shells with one another by their edges, with the interposition of an elastic joint 5 in the case of watertight or dustproof luminaires. Hooks 7 are provided at regular intervals for achieving a clamping effect of the cover against the roof.

The luminaire shown here by way of example has an elongate shape and is provided with fluorescent tubes. The Figure shows a cross-sectional view.

A plate 10 supports internal functional elements of the luminaire: inter alia an electric circuit block 15 and holders 45 for mounting fluorescent tubes 25.

The plate 10 is provided at least at each of its longitudinal sides with an edge 2 whose shape corresponds to that of the edge of the roof 20 and the edge of the cover 30 so that it is well retained between these latter two edges.

More exactly, the two longitudinal lateral walls of the roof 20 each comprise at least a portion 3 which is inclined with respect to the alignment direction of the plate when it is in position, i.e. inclined with respect to the vertical in the Figure.

The plate 10 is provided with a folded and inclined portion 2 which corresponds to the inclined portion 3 of the roof, which folded and inclined portion 2 is pressed against the corresponding inclined portion 3 of the roof when the plate, as in the present picture, is assembled with the roof. The folded portion could also be a separate part which is joined to the plate.

The cover 30 comprises reliefs 1 which project towards the interior so as to press the portion 2 of the plate 10 towards the roof 20.

The plate is thus held in place by clamping between the roof and the cover.

The inclined walls 3 of the roof comprise abutments 4 for limiting the introduction of the portion 2 of the plate into the roof.

The abutments 4 comprise a hooked portion for hooking the upper edge of the inclined portion 2 of the plate so as to prevent bending of this edge 2 into the interior, or conversely preventing bending of the edge 3 towards the exterior.

It will be obvious that the verb "comprise" does not exclude the presence of other steps or elements besides those listed in any claim.

What is claimed is:

1. A luminaire comprising a housing and a plate, said housing comprising at least a roof formed as a first half shell, said roof having two longitudinal lateral walls and being fitted with means for fixing said roof to a support, and a cover formed as a second, transparent half shell, the roof and the cover each having edges which correspond to one another so as to permit assembly of the roof and the cover by the edges, said plate supporting internal functional elements of the luminaire, wherein the plate is held in place by being clamped between the roof and the cover, against said longitudinal lateral walls.

2. A luminaire as claimed in claim 1, wherein the plate is provided with an edge whose shape corresponds to that of the edge of the roof and the edge of the cover so that said plate is retained between the edges of the roof and the cover.

3. A luminaire of elongate shape as claimed in claim 1, wherein the two longitudinal lateral walls of the roof each have a portion which is inclined with respect to the plate, the edge of the plate being provided with an inclined portion which corresponds to the inclined portion of the roof, and the inclined portion of the plate being pressed against the corresponding inclined portion of the roof when the plate is assembled between the roof and the cover.

4. A luminaire as claimed in claim 1, wherein the cover comprises reliefs which project towards the interior so as to push the plate towards the roof when the roof, the cover, and the plate are assembled together.

5. A luminaire as claimed in claim 1, wherein the longitudinal lateral walls of the roof comprise abutments for limiting the introduction of the plate into the roof when the roof, the cover, and the plate are assembled together.

6. A luminaire as claimed in claim 5, wherein the plate is provided with an edge whose shape corresponds to that of the edge of the roof and the edge of the cover, said edge of the plate being provided with an inclined portion which corresponds to the inclined portion of the roof, and the abutments comprise a hooked portion for hooking around the edge of said inclined portion of the plate.

7. A luminaire as claimed in claim 1, wherein the internal functional elements of the luminaire supported by the plate comprise an electric circuit block and holders for mounting fluorescent tubes.

8. A luminaire comprising a housing and a plate, said housing comprising at least a roof formed as a first half shell, said roof having two side walls and being fitted with means for fixing said roof to a support, and a cover formed as a second, half shell which is transparent, the roof and the cover each having edges which correspond to one another so as to permit assembly of the roof and the cover by the edges, said plate supporting internal functional elements of the luminaire, wherein the plate is held in place by clamping between the roof and the cover, and the two side walls of the roof each have a portion which is inclined with respect to the plate, the edge of the plate being provided with an inclined portion which corresponds to the inclined portion of the side wall of the roof, and the inclined portion of the plate being pressed against the corresponding inclined portion of the side wall of the roof when the plate is assembled between the roof and the cover.

9. A luminaire as claimed in claim 8, wherein the cover comprises reliefs which project towards the interior so as to push the plate towards the roof when the roof, the cover, and the plate are assembled together.

10. A luminaire as claimed in claim 8, wherein the two side walls of the roof comprise abutments for limiting the introduction of the plate into the roof when the roof, the cover, and the plate are assembled together.

11. A luminaire as claimed in claim 10, wherein the plate is provided with an edge whose shape corresponds to that of the edge of the roof and the edge of the cover, said edge of the plate being provided with an inclined portion which corresponds to the inclined portion of the roof, and the abutments comprise a hooked portion for hooking around the edge of said inclined portion of the plate.

12. A luminaire as claimed in claim 8, wherein the internal functional elements of the luminaire supported by the plate comprise an electric circuit block and holders for mounting fluorescent tubes.

13. A luminaire comprising a housing and a plate, said housing comprising at least a roof formed as a first half shell, said roof having two side walls and being attachable to a support, and a cover formed as a second half shell which is transparent, the roof and the cover each having edges which correspond to one another so as to permit assembly of the roof and the cover by the edges, said plate supporting internal functional elements of the luminaire and being held in place by clamping between the roof and the cover, the side walls of the roof comprising abutments and having a portion which is inclined with respect to the plates, the plate being provided with an edge whose shape corresponds to that of the edge of the roof and the edge of the cover, said edge of the plate being provided with an inclined portion which corresponds to the inclined portion of the roof, and the abutments comprising a hooked portion for hooking around the edge of said inclined portion of the plate.

14. A luminaire as claimed in claim 13, wherein the cover comprises reliefs which project towards the interior so as to push the plate towards the roof when the roof, the cover, and the plate are assembled together.

15. A luminaire as claimed in claim 13, wherein the internal functional elements of the luminaire supported by the plate comprise an electric circuit block and holders for mounting fluorescent tubes.

* * * * *